United States Patent [19]

Datta et al.

[11] 4,411,714

[45] Oct. 25, 1983

[54] METHOD FOR IMPROVING THE MAGNETIC PROPERTIES OF GRAIN ORIENTED SILICON STEEL

[75] Inventors: Amitava Datta, Madison, N.J.; Carl P. Stroble, Natrona Heights, Pa.

[73] Assignee: Allegheny Ludlum Steel Corporation, Pittsburgh, Pa.

[21] Appl. No.: 295,590

[22] Filed: Aug. 24, 1981

[51] Int. Cl.[3] ..... H01F 1/04

[52] U.S. Cl. ..... 148/111; 148/113

[58] Field of Search ..... 148/110, 111, 112, 113

[56] References Cited

U.S. PATENT DOCUMENTS

| | | | |
|---|---|---|---|
| 2,113,537 | 4/1938 | Hiemenz | 148/111 |
| 3,147,158 | 9/1964 | Fiedler | 148/111 |
| 3,855,019 | 12/1974 | Salsgiver et al. | 148/112 |
| 3,959,033 | 5/1976 | Barisoni et al. | 148/112 |
| 4,014,717 | 3/1977 | Barisoni et al. | 148/111 |
| 4,115,160 | 9/1978 | Benford et al. | 148/111 |

*Primary Examiner*—John P. Sheehan

*Attorney, Agent, or Firm*—Patrick J. Viccaro

[57] ABSTRACT

A method for improving the magnetic permeability and core loss of grain oriented silicon steel; the improvement in these magnetic properties is achieved by conducting annealing prior to cold rolling at a temperature above the temperature at which transformation to austenite occurs and thereafter quenching said steel.

3 Claims, 3 Drawing Figures

AC — Air Cooled From Band Normalize Temperature (1750°F)

BQ — Brine Quenched From Band Normalize Temperature (1750°F)

N — "Normal" Final Normalize (1475°F / 3 mins. / 50°F D.P.)

D — "Duplex" Final Normalize (1800°F / 30 secs. / 50°F D.P. + 1475°F / 3 mins. / 50°F D.P.)

AC — Air Cooled From Band Normalize Temperature (1750° F)

BQ — Brine Quenched From Band Normalize Temperature (1750° F)

N — "Normal" Final Normalize (1475° F / 3 mins. / 50° F D.P.)

D — "Duplex" Final Normalize (1800° F / 30 secs. / 50° F D.P. + 1475° F / 3mins. / 50° F D.P.)

METHOD FOR IMPROVING THE MAGNETIC PROPERTIES OF GRAIN ORIENTED SILICON STEEL

Grain oriented silicon steel, in the form of sheets, is used for the manufacture of various electrical devices such as iron cores for transformers. Conventionally, the steel is produced by hot rolling followed by at least one cold rolling step with an annealing step prior to each cold rolling. After final cold rolling the steel is subjected to a high-temperature normalizing treatment during which decarburization is achieved. If the steel is to be oriented so that it is characterized by, in addition to primary recrystallization, secondary recrystallization in the (110) [001] position, which is termed the cube-on-edge position the steel is subjected to a final texture annealing cycle during which the secondary recrystallization is obtained. In the various electrical applications for which grain oriented silicon steel is used, and specifically when used in the manufacture of transformer cores, the material is required to have in combination good magnetic permeability and reduced core loss. It is known that reduced core loss may be promoted by achieving improved grain orientation.

It is accordingly the primary object of the present invention to provide a method for improving the magnetic properties, specifically core loss, of grain oriented silicon steel by improving the grain orientation thereof.

This and other objects of the invention as well as a more complete understanding thereof may be obtained from the following description, specific examples and drawings, in which.

As discussed above, it is known that the core los of grain oriented silicon steel is reduced as the grain orientation is improved. It has been found, in accordance with the present invention, that if during annealing prior to conventional cold rolling the steel is heated for a time at temperature above the austenite-transformation temperature and then quenched the steel will be characterized by the presence of a secondary phase, which may consist of martensite, bainite or pearlite. This secondary phase results from and is retained during the rapid cooling achieved by quenching as opposed to conventional air cooling. As is well known, the higher the quench rate the greater will be the volume fraction of the secondary transformation product. Also affecting the volume fraction of secondary transformation product will be the time and temperature to which the steel is heated and held above the austenite transformation temperature. The longer the time, until equilibrium is attained, and the higher the temperature, up to about 2100° F., at actual commercial silicon levels (3.0—3.30 Si) there will generally be more transformation to austenite and thus more secondary transformation product upon quenching. The cooling rate, therefore, in combination with the time at temperature above the austenite transformation temperature will be determinative of the volume fraction of secondary transformation product. Although this will vary from composition to composition it may easily be determined from routine experimentation for specific compositions of grain oriented silicon steel. With this determination the quantity of secondary transformation product for a specific composition to obtain optimum magnetic properties, and particularly core loss, may be likewise determined and achieved in accordance with the desired properties.

Although the invention has applicability to grain oriented silicon steels generally it finds particular advantage, as will be seen from the specific examples discussed hereinbelow, with a silicon steel composition SX-14 having the following composition limits in percent by weight:

| | | |
|---|---|---|
| .015-.06 | C. | .005-.025 S |
| 2.5-4.0 | Si | 1.0 Cu |
| .015-.15 | Mn | .0045 N, max. |
| .0006-.008 | B | .008 Al, max. |

Further, in accordance with the invention it has been found that the properties may be further improved, particularly from the standpoint of reduced core loss if, after cold rolling, the final normalizing involves a duplex heat treatment during which the steel is first heated to a temperature above the austenite transformation temperature and thereafter conventionally normalized at a lower temperature. Following this duplex heat treatment the material is further processed in the conventional manner by coating and final texture annealing.

Figure 1:
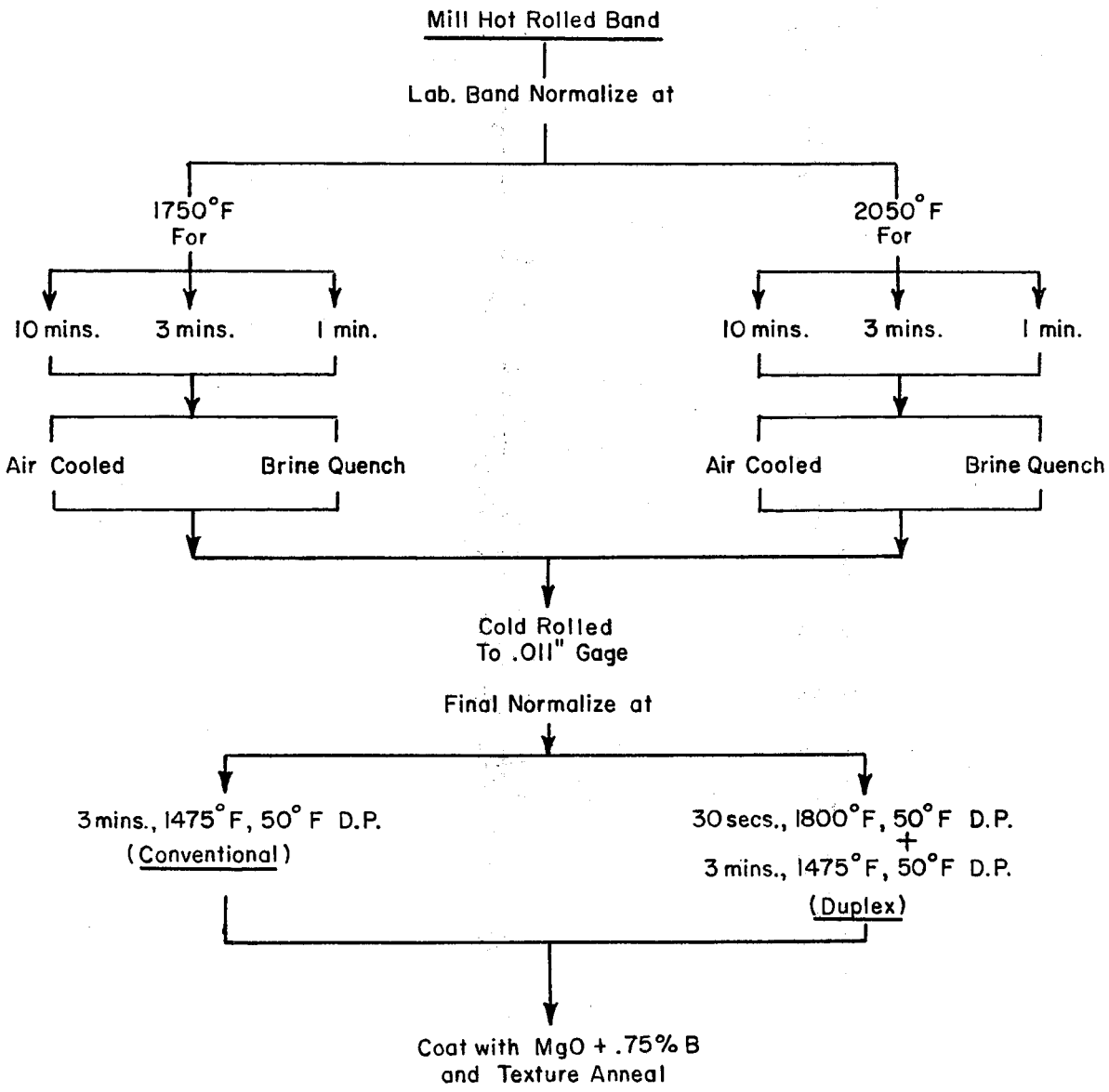
FIG. 1 is a schematic showing of the method in accordance with the invention as compared to the conventional practice for producing grain oriented silicon steel.

By way of specific example to examine the effect of quenching, as opposed to conventional air cooling, after annealing above the austenite transformation temperature mill hot-rolled band samples of the composition set forth on Table I were processed using the annealing and quenching practices in accordance with the invention as compared to conventional practice; experimental processing practices are summarized in FIG. 1 of the drawings:

TABLE I

| Heat No. | Coil | Si | C | Mn | S | B | Cu | Fe |
|---|---|---|---|---|---|---|---|---|
| 151816 | 4 | 3.14 | .033 | .040 | .021 | .0016 | .38 | Balance |
| 151818 | 3 | 3.13 | .029 | .037 | .019 | .0028 | .35 | Balance |
| 151819 | 2 | 3.13 | .030 | .041 | .021 | .0009 | .50 | Balance |

Figure 2:
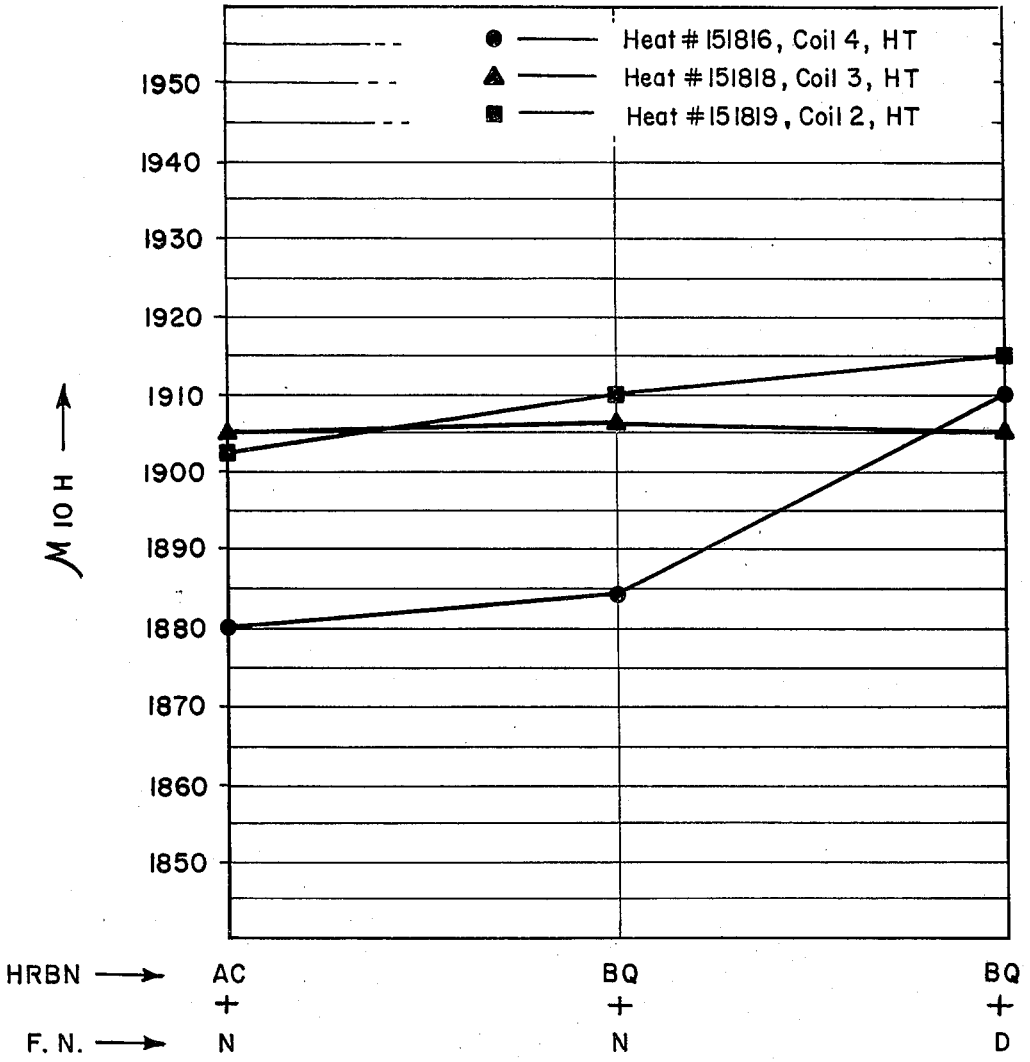
FIG. 2 is a graph showing the improvement in magnetic permeability achieved by the practice of the invention in comparison with conventional practice.
Figure 3:
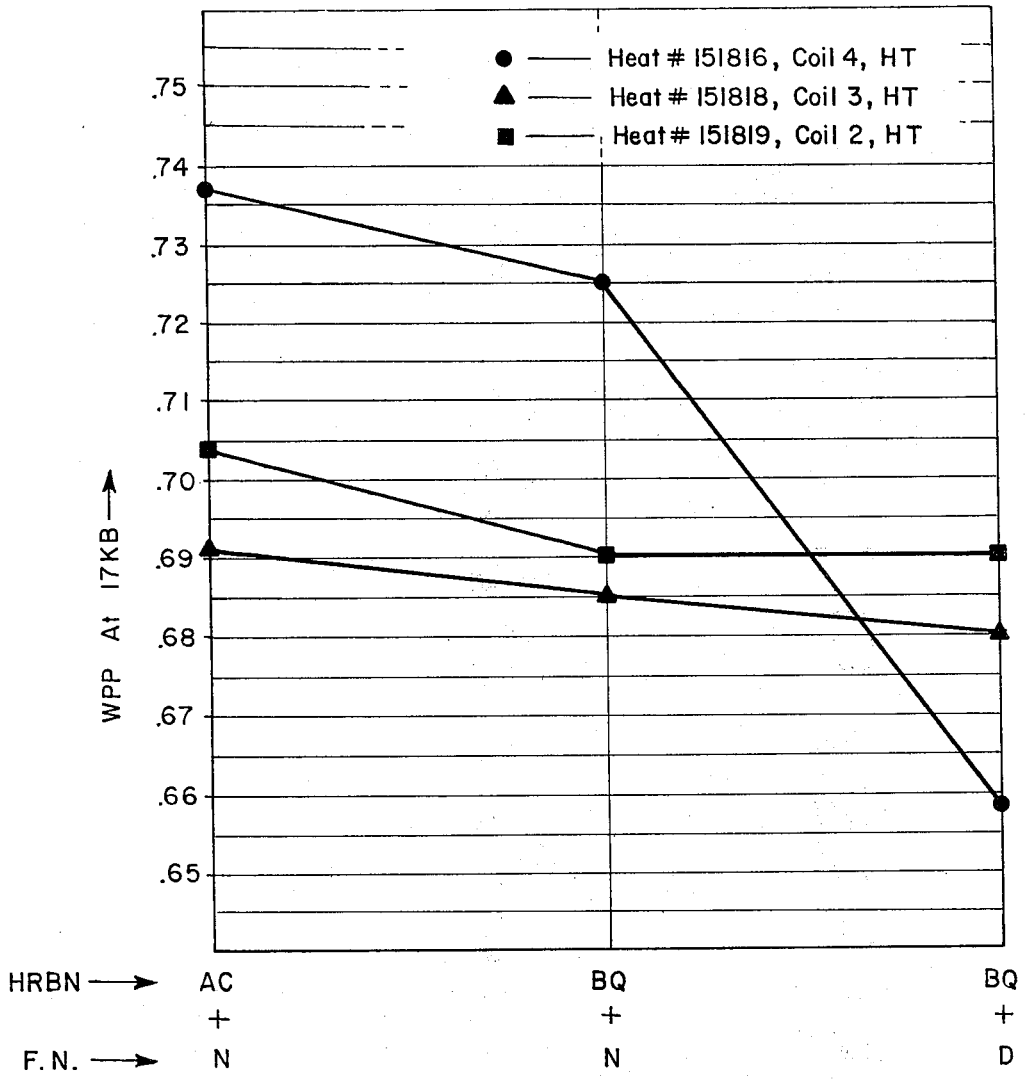
FIG. 3 is a graph showing the improvement in core loss obtained with the practice of the invention in comparison with conventional practice.

The magnetic properties and specifically the magnetic permeability values are shown in FIG. 2 and the core loss values are shown in FIG. 3 of the drawings. These FIGURES present a graphic showing of the magnetic property values set forth in Table II.

TABLE II

| Heat #151819, Coil #2, HT | | | | |
|---|---|---|---|---|
| HEAT TREATMENT | | F.N. | μ10H | WPP 17 KB |
| | | N* | 1901 | .675 |
| | AC | | | |
| | | D** | 1818 | .715 |
| 1750° F., 1 min | | | | |
| | | N | 1873 | .727 |
| | BQ | | | |
| | | D | 1900 | .680 |
| | | N | 1903 | .704 |
| | AC | | | |
| | | D | 1887 | .720 |
| 1750° F., 3 mins | | | | |
| | | N | 1910 | .690 |

TABLE II-continued

| | | | | |
|---|---|---|---|---|
| | BQ | | | |
| | | D | 1915 | .689 |
| | | N | 1829 | .813 |
| | AC | | | |
| | | D | 1847 | .787 |
| 1750° F., 10 mins | | | | |
| | | N | 1836 | .796 |
| | BQ | | | |
| | | D | 1832 | .802 |

Heat #151818, Coil #3, HT

| HEAT TREATMENT | | F.N. | μ10H | WPP 17 KB |
|---|---|---|---|---|
| | | N | 1905 | .688 |
| | AC | | | |
| | | D | 1900 | .664 |
| 1750° F., 1 min | | | | |
| | | N | 1887 | .695 |
| | BQ | | | |
| | | D | 1870 | .725 |
| | | N | 1905 | .691 |
| | AC | | | |
| | | D | 1925 | .658 |
| 1750° F., 3 mins | | | | |
| | | N | 1906 | .685 |
| | BQ | | | |
| | | D | 1906 | .680 |
| | | N | 1761 | .940 |
| | AC | | | |
| | | D | 1854 | .721 |
| 1750° F., 10 mins | | | | |
| | | N | 1769 | .897 |
| | BQ | | | |
| | | D | 1716 | .980 |

Heat #151816, Coil #4, HT

| HEAT TREATMENT | | F.N. | μ10H | WPP 17 KB |
|---|---|---|---|---|
| | | N | 1861 | .757 |
| | AC | | | |
| | | D | 1918 | .660 |
| 1750° F., 1 min | | | | |
| | | N | 1883 | .709 |
| | BQ | | | |
| | | D | 1908 | .681 |
| | | N | 1880 | .737 |
| | AC | | | |
| | | D | 1912 | .674 |
| 1750° F., 3 mins | | | | |
| | | N | 1884 | .725 |
| | BQ | | | |
| | | D | 1909 | .658 |
| | | N | 1878 | .738 |
| | AC | | | |
| | | D | 1913 | .693 |
| 1750° F., 10 mins | | | | |
| | | N | 1877 | .744 |
| | BQ | | | |
| | | D | 1925 | .650 |

Heat #151819, Coil #2, HT

| HRBN TREATMENT | | F.N. | μ10H | WPP 17 KB |
|---|---|---|---|---|
| | | N | 1769 | .896 |
| | AC | | | |
| | | D | 1529 | 1.43 |
| 2050° F., 1 min | | | | |
| | | N | 1575 | 1.31 |
| | BQ | | | |
| | | D | 1798 | .832 |
| | | N | 1805 | .848 |
| | AC | | | |
| | | D | 1497 | — |
| 2050° F., 3 mins | | | | |
| | | N | 1809 | .861 |
| | BQ | | | |
| | | D | 1596 | 1.25 |
| | | N | 1444 | — |
| | AC | | | |
| | | D | 1448 | — |
| 2050° F., 10 mins | | | | |
| | | N | 1500 | — |

TABLE II-continued

| | | | | |
|---|---|---|---|---|
| | BQ | | | |
| | | D | 1460 | — |

Heat #151818, Coil #3, HT

| HRBN TREATMENT | | F.N. | μ10H | WPP 17 KB |
|---|---|---|---|---|
| | | N | 1492 | — |
| | AC | | | |
| | | D | 1468 | — |
| 2050° F., 1 min | | | | |
| | | N | 1653 | 1.12 |
| | BQ | | | |
| | | D | 1462 | — |
| | | N | 1468 | — |
| | AC | | | |
| | | D | 1460 | — |
| 2050° F., 3 mins | | | | |
| | | N | 1684 | 1.06 |
| | BQ | | | |
| | | D | 1466 | — |
| | | N | 1429 | — |
| | AC | | | |
| | | D | 1445 | — |
| 2050° F., 10 mins | | | | |
| | | N | 1445 | — |
| | BQ | | | |
| | | D | 1439 | — |

Heat #151816, Coil #4, HT

| HRBN TREATMENT | | F.N. | μ10H | WPP 17 KB |
|---|---|---|---|---|
| | | N | 1786 | .890 |
| | AC | | | |
| | | D | 1545 | 1.32 |
| 2050° F., 1 min | | | | |
| | | N | 1783 | .908 |
| | BQ | | | |
| | | D | 1517 | — |
| | | N | 1697 | 1.05 |
| | AC | | | |
| | | D | 1475 | — |
| 2050° F., 3 mins | | | | |
| | | N | 1770 | .915 |
| | BQ | | | |
| | | D | 1523 | 1.40 |
| | | N | 1474 | — |
| | AC | | | |
| | | D | 1458 | — |
| 2050° F., 10 mins | | | | |
| | | N | 1489 | — |
| | BQ | | | |
| | | D | 1468 | — |

3 mins. 1475° F.

*N = Normal cycle, 1475° F., 6"/Min belt speed, 50° F. d.p. in $80N_2/20H_2$ dew point 30 secs. 1800° F.,

**D = Duplex cycle, 1800° F. 20"/Min belt speed, 50° F. d.p. in $80N_2/20H_2$ + Normal cycle. dew point As may be seen from these data and particularly the data shown for Heat No. 151816 the quenching practice after annealing in accordance with the invention provides significant improvement particularly from the standpoint of reduced core loss. Further in this regard additional time at temperature during annealing further contributes to reduced core loss. In addition, the duplex final normalizing treatment, in accordance with the invention, showed further improvement with respect to reduced core loss for the silicon steel composition represented by heat 151816. Although any suitable quenching practice will be satisfactory for use with the invention quenching in a brine quenching medium has been found effective as demonstrated by the above-referenced specific example. As is well known, the more drastic the quench the more secondary transformation product will be retained thereafter. Consequently, when it has been determined for a specific silicon steel composition the extent of retained transformation product desired to achieve the required magnetic properties, this may be obtained by controlling the time and temperature above the austenite transformation temperature with the degree or rapidness of the quench employed. By controlling these basic processing parameters the desired volume fraction of secondary transformation product may be achieved.

What we claim is:

1. In a method for producing grain oriented silicon steel including the steps of hot-rolling, at least one cold-rolling step with an annealing step prior to each cold-rolling, final normalizing, coating and final texture annealing, the improvement comprising during at least one said annealing step immediately prior to cold-rolling, heating said steel at a time and temperature at which transformation to austenite occurs, then quenching said steel prior to cold-rolling and immediately prior to final normalizing, heating said steel to a temperature above the austenite transformation temperature to provide a combination of good magnetic permeability and reduced core loss.

2. The method of claim 1 wherein said quenching is performed in a brine quenching medium.

3. The method of claim 1 wherein said steel consists essentially of, in weight percent, 0.015 to 0.06 carbon, 2.5 to 4.0 silicon, 0.015 to 0.15 manganese, 0.0006 to 0.008 boron, 0.005 to 0.025 sulfur, 0.0045 nitrogen max., 0.008 aluminum max., up to 1.0 copper and balance iron.

* * * * *